US009416534B2

(12) United States Patent
Kovitch

(10) Patent No.: US 9,416,534 B2
(45) Date of Patent: Aug. 16, 2016

(54) INTERLOCKING BLOCK CONSTRUCTION SYSTEM

(71) Applicant: Andrew Kovitch, Trucksville, PA (US)

(72) Inventor: Andrew Kovitch, Trucksville, PA (US)

( * ) Notice: Subject to any disclaimer, the term of this patent is extended or adjusted under 35 U.S.C. 154(b) by 9 days.

(21) Appl. No.: 14/183,166

(22) Filed: Feb. 18, 2014

(65) Prior Publication Data

US 2014/0230357 A1 Aug. 21, 2014

Related U.S. Application Data

(60) Provisional application No. 61/765,436, filed on Feb. 15, 2013.

(51) Int. Cl.

| | |
|---|---|
| ***E04B 2/18*** | (2006.01) |
| ***E04B 2/08*** | (2006.01) |
| *E04B 2/02* | (2006.01) |

(52) U.S. Cl.

CPC ... *E04B 2/18* (2013.01); *E04B 2/08* (2013.01); *E04B 2002/0206* (2013.01); *E04B 2002/0247* (2013.01); *E04B 2002/0263* (2013.01); *E04B 2002/0265* (2013.01)

(58) Field of Classification Search

CPC ..... E04B 2/8652; E04B 2002/0206; E04B 2002/867; E04B 2/18; E04B 2/08

USPC ..... 52/592.6, 564, 605, 223.7, 293.3, 52/293.2, 592.1, 241, 267, 270, 271, 779, 52/780, 574, 606, 607, 608, 609, 610, 52/611; 256/1, 19, 24; 446/124

See application file for complete search history.

(56) References Cited

U.S. PATENT DOCUMENTS

| | | | | | |
|---|---|---|---|---|---|
| 764,459 | A * | 7/1904 | Hackman | 52/591.1 |
| 1,171,191 | A * | 2/1916 | Gronert | 52/591.1 |
| 1,434,612 | A * | 11/1922 | Hamilton | 52/436 |
| 1,477,867 | A * | 12/1923 | Dodson | 52/223.7 |
| 3,410,044 | A * | 11/1968 | Moog | 52/309.12 |
| 3,698,692 | A * | 10/1972 | Burrows, Jr. | 256/19 |
| 4,121,397 | A * | 10/1978 | Marcocci et al. | 52/286 |
| 4,193,584 | A * | 3/1980 | Wieser | 256/19 |
| 5,623,797 | A * | 4/1997 | Gravier et al. | 52/284 |
| 6,244,009 | B1 * | 6/2001 | Cerrato | 52/604 |
| 6,508,038 | B2 * | 1/2003 | Al-Ghitta | 52/505 |
| 6,523,312 | B2 * | 2/2003 | Budge | 52/284 |
| 6,571,521 | B1 * | 6/2003 | Ameigh | 52/295 |
| 7,108,577 | B2 * | 9/2006 | Peters et al. | 446/124 |
| 7,802,409 | B2 * | 9/2010 | Stott | 52/295 |
| 8,171,688 | B2 * | 5/2012 | Junker | 52/426 |
| 2006/0265982 | A1 * | 11/2006 | Greenberg et al. | 52/293.1 |

* cited by examiner

*Primary Examiner* — Joshua J Michener
*Assistant Examiner* — Matthew Gitlin
(74) *Attorney, Agent, or Firm* — Dunlap Bennett & Ludwig PLLC

(57) ABSTRACT

An interlocking block construction system is provided. A plurality of interlocking blocks may each include: a top portion having a top protruding ridge; a bottom portion having a bottom recessed channel; a first side having a side protruding ridge; and a second side having a side recessed channel. The top protruding ridge of a first interlocking block is formed to fit within a bottom recessed channel of a second interlocking block. The side protruding ridge of the second interlocking block is formed to fit within a side recessed channel of a third interlocking block. The plurality of interlocking blocks connected together form a wall.

9 Claims, 4 Drawing Sheets

INTERLOCKING BLOCK CONSTRUCTION SYSTEM

CROSS-REFERENCE TO RELATED APPLICATION

This application claims the benefit of priority of U.S. provisional application No. 61/765,436, filed Feb. 15, 2013, the contents of which are herein incorporated by reference.

BACKGROUND OF THE INVENTION

The present invention relates to a construction system and, more particularly, to an interlocking block construction system.

Currently, the flooding of basements can cause serious damage to a building. The damage caused may be very costly. Currently, there is no structure that prevents the flooding altogether.

As can be seen, there is a need for a structure to prevent flooding within a building.

SUMMARY OF THE INVENTION

In one aspect of the present invention, an apparatus comprises: a plurality of interlocking blocks each comprising: a top portion comprising a top protruding ridge; a bottom portion comprising a bottom recessed channel; a first side comprising a side protruding ridge; and a second side comprising a side recessed channel, wherein the top protruding ridge of a first interlocking block is formed to fit within a bottom recessed channel of a second interlocking block, and wherein a side protruding ridge of the second interlocking block is formed to fit within a side recessed channel of a third interlocking block, wherein a plurality of interlocking blocks connected together form a wall.

These and other features, aspects and advantages of the present invention will become better understood with reference to the following drawings, description and claims.

DETAILED DESCRIPTION OF THE INVENTION

Figure 1:
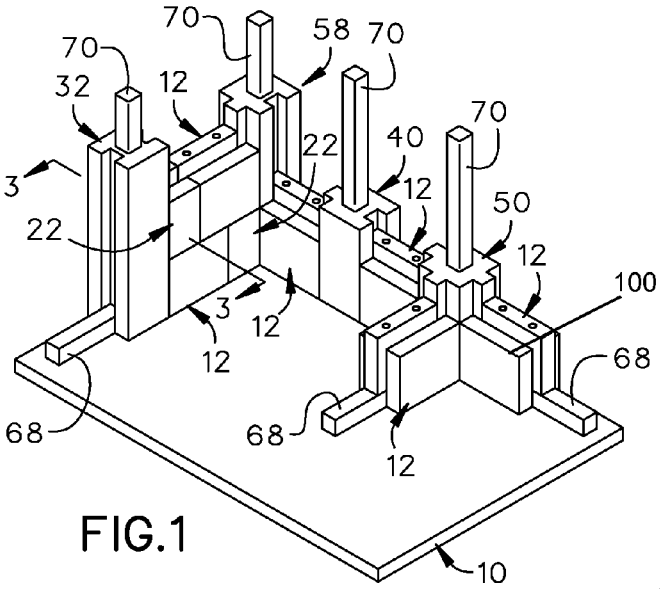
FIG. 1 is a perspective view of the present invention shown in exemplary configuration.
Figure 3:
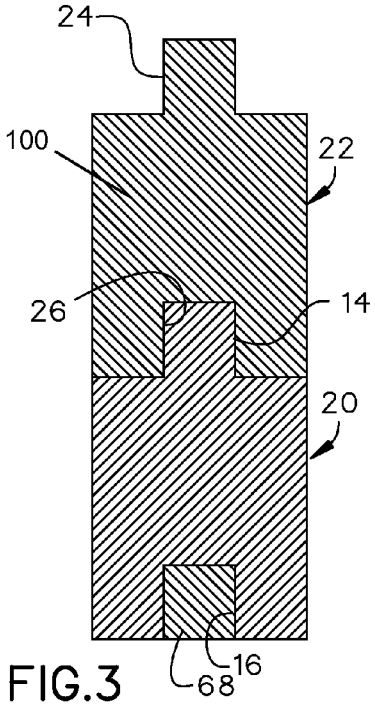
FIG. 3 is a section detail view of the present invention along line 3-3 in FIG. 1.
Figure 2:
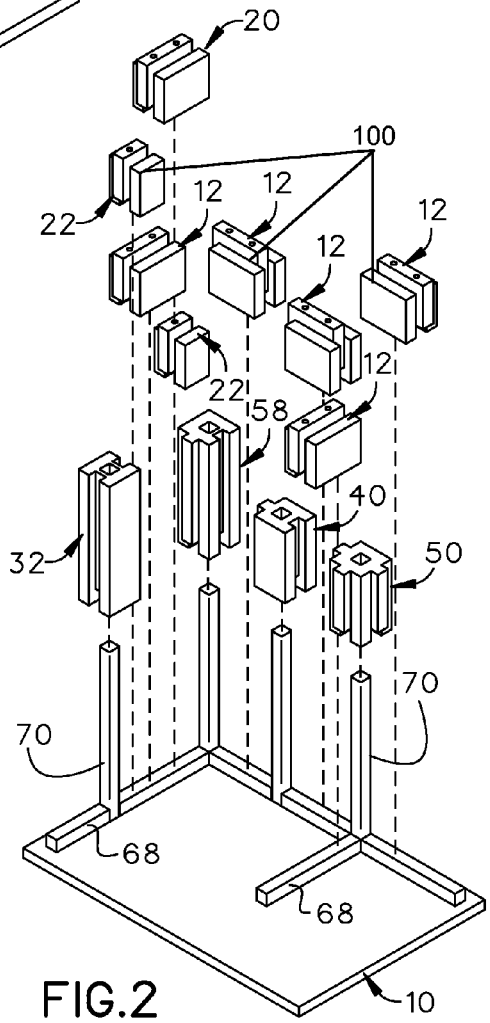
FIG. 2 is an exploded view of the present invention in the exemplary configuration.
Figure 4:
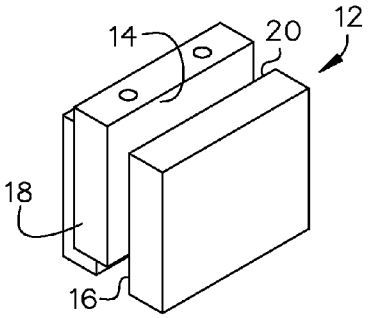
FIG. 4 is a top perspective view of the large block of the present invention.
Figure 5:
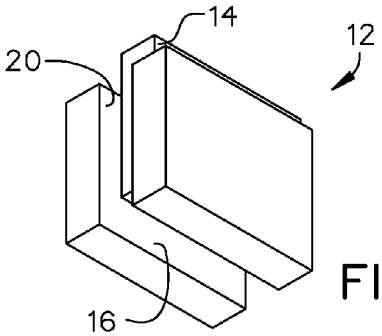
FIG. 5 is a bottom perspective view of the large block of the present invention.
Figure 6:
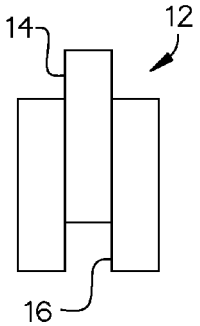
FIG. 6 is a front view of the large block of the present invention
Figure 7:
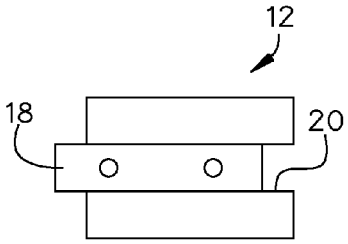
FIG. 7 is a top view of the large block of the present invention.
Figure 8:
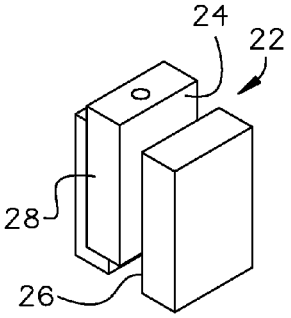
FIG. 8 is a top perspective view of the small block of the present invention.
Figure 9:
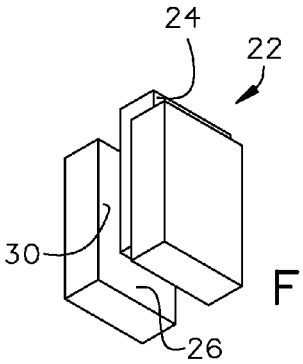
FIG. 9 is a bottom perspective view of the small block of the present invention.
Figure 10:
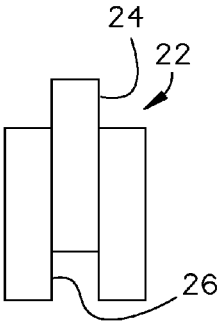
FIG. 10 is a front view of the small block of the present invention.
Figure 11:
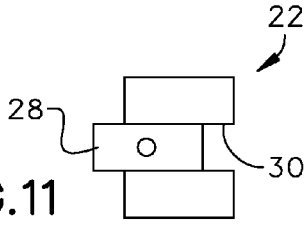
FIG. 11 is a top view of the small block of the present invention.
Figure 12:
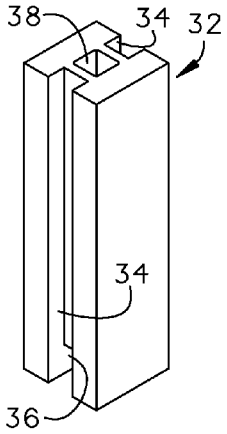
FIG. 12 is a top perspective view of the female-female pillar of the present invention.
Figure 13:
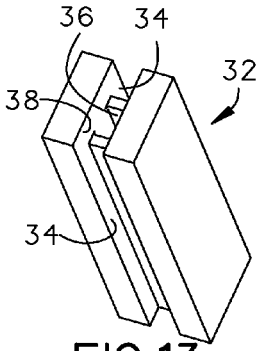
FIG. 13 is a bottom perspective view of the female-female pillar of the present invention.
Figure 14:
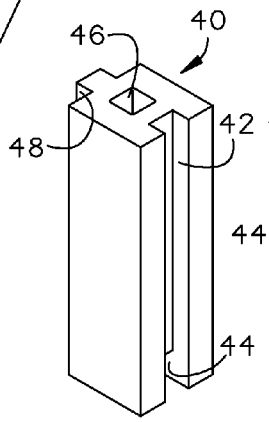
FIG. 14 is a top perspective view of the male-female pillar of the present invention.
Figure 15:
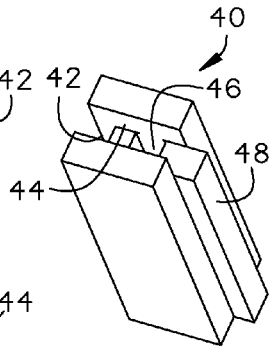
FIG. 15 is a bottom perspective view of the male-female pillar of the present invention.
Figure 16:
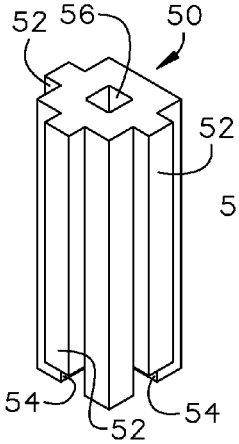
FIG. 16 is a top perspective view of the T-intersection male pillar of the present invention.
Figure 17:
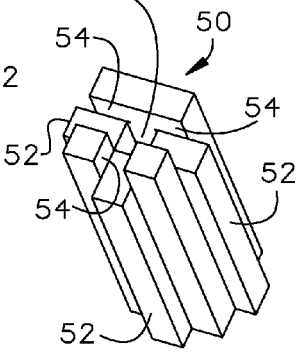
FIG. 17 is a bottom perspective view of the 50 T-intersection male pillar of the present invention.
Figure 18:
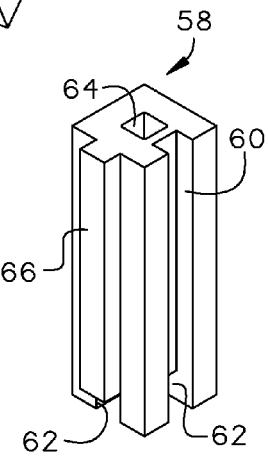
FIG. 18 is a top perspective view of the corner male-female pillar of the present invention.
Figure 19:
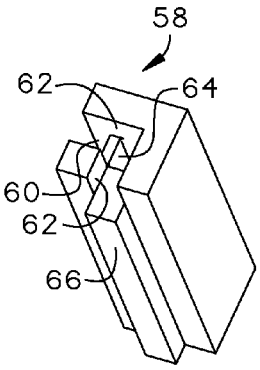
FIG. 19 is a bottom perspective view of the corner male-female pillar of the present invention.
Figure 20:
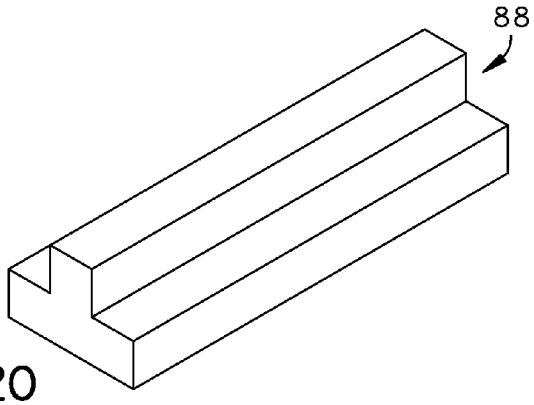
FIG. 20 is a perspective view of the male starter strip of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a block system that may be used all over the world to make dikes to stop flooding, walls, roads, pools, decks, sheds, homes, factories, inside walls, outside walls and more. In certain embodiments, the blocks of the present invention may be made of a polymer, such as plastic which facilitates a waterproof barrier. The block system of the present invention may be used to build new homes or may be used with older houses to keep out water. The present invention may be installed at the base of the houses to prevent the entry of water. The round blocks can be used to make big round pipes and pools.

Referring to FIGS. 1 through 22 the present invention includes an interlocking block construction system. The interlocking block construction system may include a plurality of interlocking blocks 100. The plurality of interlocking blocks 100 may each include: a top portion having a top protruding ridge 14; a bottom portion having a bottom recessed channel 16; a first side having a side protruding ridge 18; and a second side having a side recessed channel 20. The top protruding ridge 14 of a first interlocking block 100 is formed to fit within a bottom recessed channel 16 of a second interlocking block 100. The side protruding ridge 18 of the second interlocking block 100 is formed to fit within a side recessed channel 20 of a third interlocking block 100. The plurality of interlocking blocks 100 connected together form a wall.

In certain embodiments, the present invention may include different sized interlocking blocks 100. For example, there may be a larger interlocking block 12 and a small interlocking block 22. The different sizes may be used to adjust to different sized walls. The small interlocking block 22 may each include: a top portion having a top protruding ridge 24; a bottom portion having a bottom recessed channel 26; a first side having a side protruding ridge 28; and a second side having a side recessed channel 30. The top protruding ridge 24 of a small interlocking block 22 is formed to fit within a bottom recessed channel 16 of a large interlocking block 12. The side protruding ridge 28 of the small interlocking block 22 is formed to fit within a side recessed channel 20 of a large interlocking block 12. Therefore, the small blocks 22 and the large blocks 12 may connect together to form the wall.

In certain embodiments, the present invention may further include a mounting base 10. The mounting base 10 may support the constructed wall. The mounting base 10 may include a base strip 68 sized to fit within the bottom recessed channel 16, 26 of the small block 22 and the large block 12. In certain embodiments, the base strip 68 may be sized to fit within the side recessed channel 20, 30 of the small block 22 and the large block 12. In certain embodiments, the present invention may include a plurality of posts 70 protruding vertically from the mounting base 10 and substantially perpendicular relative to the base strip 68. The posts 70 may intersect with the base strip 68. The base 10 may further be made out of a plurality of male starter strips 88.

The present invention may include at least one female-female pillar 32. The female-female pillar 32 may include: a top portion; a bottom portion including a bottom recessed channel 36; a first side including a first side recessed channel 34; and a second side including a second side recessed channel 34. The top protruding ridge 14 and the side protruding ridge 18 of the plurality of interlocking blocks 100 is formed to fit within the first side recessed channel 34 and the second side recessed channel 34. The base strip 68 is formed to fit within the bottom recessed channel 36. In certain embodiments, the female-female pillar 32 further includes a center channel 38. The plurality of posts 70 is formed to fit within the center channel 38.

The present invention may include at least one male-female pillar 40. The male-female pillar 40 may include: a top portion; a bottom portion including a bottom recessed channel 44; a first side including a side recessed channel 42; and a second side including a side protruding ridge 48. The top protruding ridge 14 and the side protruding ridge 18 of the plurality of interlocking blocks 100 is formed to fit within the first side recessed channel 42. The side protruding ridge 48 of the the male-female pillar 40 is formed to fit within the bottom recessed channel 16 and the side recessed channel 20 of the plurality of blocks 100. The base strip 68 is formed to fit within the bottom recessed channel 44. The male-female pillar 40 may include a center channel 46. The posts 70 are formed to fit within the center channel 46.

The present invention may include at least one T-intersection male pillar 50 including: a top portion; a bottom portion including a first bottom recessed channel 54 and a second bottom recessed channel 54 substantially perpendicular to the first bottom recessed channel 54; a first side including a first side protruding ridge 52; a second side including a second side protruding ridge 52; a front portion including a front portion protruding ridge 52; and a rear portion. The first side protruding ridge 52, the second side protruding ridge 52, and front portion protruding ridge 52 of the T-intersection male pillar 50 is formed to fit within the bottom recessed channel 16 and the side recessed channel 20 of the plurality of blocks 100. The base strip 68 is formed to fit within the first bottom recessed channel 54 and the second bottom recessed channel 54. The T-intersection male pillar 50 further includes a center channel 56. The posts 70 are formed to fit within the center channel 56.

The present invention may include at least one corner male-female pillar 58 including: a top portion; a bottom portion including a first bottom recessed channel 62 and a second bottom recessed channel 62 substantially perpendicular to the first bottom recessed channel 62; a first side including a side recessed channel 60; a second side; a front portion including a front portion protruding ridge 66; and a rear portion. The top protruding ridge 14 and the side protruding ridge 18 of the plurality of interlocking blocks 100 is formed to fit within the side recessed channel 60 of the corner male-female pillar 58. The front portion protruding ridge 66 of the corner male-female pillar 58 is formed to fit within the bottom recessed channel 16 and the side recessed channel 20 of the plurality of blocks 100. The base strip 68 is formed to fit within the first bottom recessed channel 62 and the second bottom recessed channel 62 of the corner male-female pillar 58. The corner male-female pillar 58 further includes a center channel 64. The posts 70 are formed to fit within the center channel 64.

Figure 21:
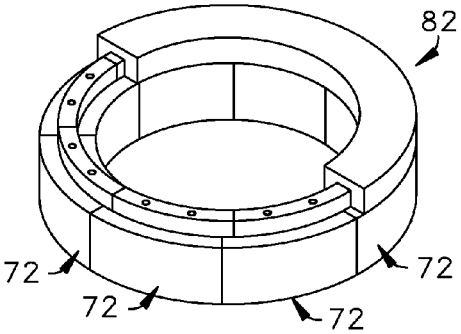
FIG. 21 is a perspective view of an alternate embodiment of the present invention shown in exemplary configuration.
Figure 22:
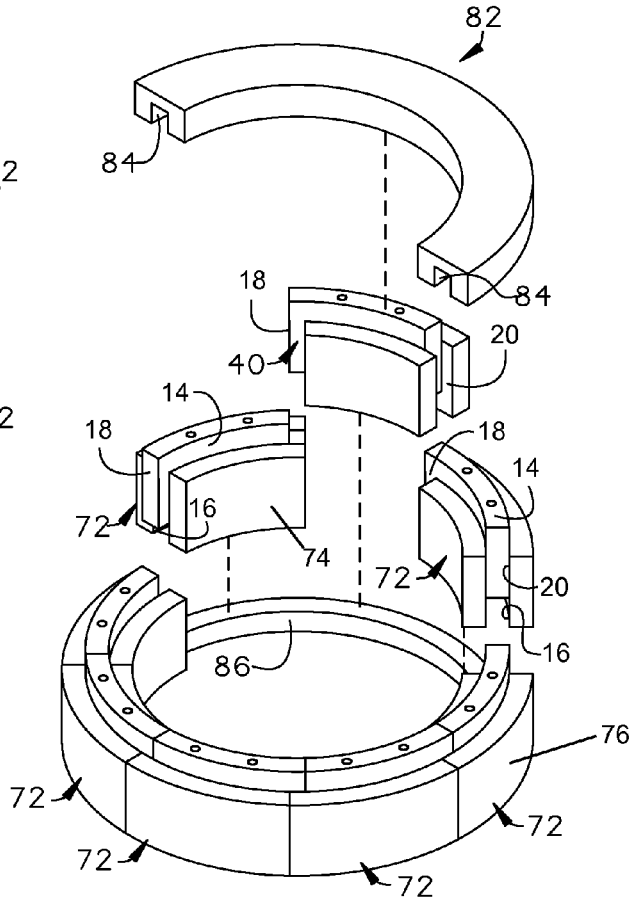
FIG. 22 is an exploded view of an alternate embodiment of the present invention exemplary configuration.

In certain embodiments, the interlocking blocks 100 may be curved interlocking blocks 72. The curved interlocking blocks 72 may include a curved inside surface 74 and a curved outside surface 76. The curved interlocking blocks 72 are configured to form a circle when the plurality of interlocking blocks 72 are connected, as illustrated in FIG. 21. The present invention may further include a curved cap 82 having a curved cap slot 84. The top protruding ridge 14 is formed to fit within the curved cap slot 84. The present invention may include a curved strip 86. The curved strip 86 is formed to fit within the bottom recessed channel 16 of the curved interlocking blocks 72.

It should be understood, of course, that the foregoing relates to exemplary embodiments of the invention and that modifications may be made without departing from the spirit and scope of the invention as set forth in the following claims.

What is claimed is:

1. An apparatus comprising:

a plurality of interlocking blocks each comprising:

a top portion comprising a top protruding ridge;

a bottom portion comprising a bottom recessed channel;

a first side comprising a side protruding ridge; and a second side comprising a side recessed channel, wherein the top protruding ridge of a first interlocking block is formed to fit within a bottom recessed channel of a second interlocking block, and wherein a side protruding ridge of the second interlocking block is formed to fit within a side recessed channel of a third interlocking block, wherein a plurality of interlocking blocks connected together form a wall;

a mounting base comprising a base strip sized to fit within at least one of the bottom recessed channel and the side recessed channel; and at least one T-intersection male pillar comprising:

a top portion;

a bottom portion comprising a first bottom recessed channel and a second bottom recessed channel substantially perpendicular to the first bottom recessed channel;

a first side comprising a first side protruding ridge;

a second side comprising a second side protruding ridge;

a front portion comprising a front portion protruding ridge; and a rear portion, wherein the first side protruding ridge, the second side protruding ridge, and front portion protruding ridge of the at least T-intersection male pillar is formed to fit within at least one of the bottom recessed channel and the side recessed channel of the plurality of blocks, wherein the base strip is formed to fit within the first bottom recessed channel and the second bottom recessed channel, wherein the at least one T-intersection male pillar further comprises a center channel, wherein one of the plurality of posts is formed to fit within the center channel.

2. The apparatus of claim 1, wherein the plurality of interlocking blocks comprises a plurality of large interlocking blocks, and a plurality of small interlocking blocks.

3. The apparatus of claim 1, further comprising a plurality of posts protruding vertically from the mounting base and substantially perpendicular relative to the base strip.

4. The apparatus of claim 1, further comprising:

at least one female-female pillar comprising:

a top portion;

a bottom portion comprising a bottom recessed channel;

a first side comprising a first side recessed channel; and a second side comprising a second side recessed channel, wherein at least one of the top protruding ridge and the side protruding ridge of the plurality of interlocking blocks is formed to fit within the first side recessed channel and the second side recessed channel, wherein the base strip is formed to fit within the bottom recessed channel, wherein the at least one female-female pillar further comprises a center channel, wherein one of the plurality of posts is formed to fit within the center channel.

5. The apparatus of claim 1, further comprising:

at least one male-female pillar comprising:

a top portion;

a bottom portion comprising a bottom recessed channel;

a first side comprising a side recessed channel; and a second side comprising a side protruding ridge, wherein at least one of the top protruding ridge and the side protruding ridge of the plurality of interlocking blocks is formed to fit within the first side recessed channel, wherein the side protruding ridge of the at least one male-female pillar is formed to fit within at least one of the bottom recessed channel and the side recessed channel of the plurality of blocks, wherein the base strip is formed to fit within the bottom recessed channel, wherein the at least one male-female pillar further comprises a center channel, wherein one of the plurality of posts is formed to fit within the center channel.

6. The apparatus of claim 1, further comprising:

at least one corner male-female pillar comprising:

a top portion;

a bottom portion comprising a first bottom recessed channel and a second bottom recessed channel substantially perpendicular to the first bottom recessed channel;

a first side comprising a side recessed channel;

a second side;

a front portion comprising a front portion protruding ridge; and a rear portion, wherein at least one of the top protruding ridge and the side protruding ridge of the plurality of interlocking blocks is formed to fit within the side recessed channel of the corner male-female pillar, wherein the front portion protruding ridge of the corner male-female pillar is formed to fit within at least one of the bottom recessed channel and the side recessed channel of the plurality of blocks, the base strip is formed to fit within the first bottom recessed channel and the second bottom recessed channel of the corner male-female pillar, wherein the corner male-female pillar further comprises a center channel, wherein one of the plurality of posts is formed to fit within the center channel.

7. The apparatus of claim 1, wherein the plurality of interlocking blocks further comprise a curved inside surface and a curved outside surface, wherein the plurality of interlocking blocks is configured to form a circle when the plurality of interlocking blocks are connected.

8. The apparatus of claim 7, further comprising a support structure comprising:

a curved cap comprising a curved cap slot, wherein the top protruding ridge is formed to fit within the curved cap slot; and a curved strip formed to fit within the bottom recessed channel.

9. An apparatus comprising:

a plurality of interlocking blocks each comprising:

a top portion comprising a top protruding ridge;

a bottom portion comprising a bottom recessed channel;

a first side comprising a side protruding ridge; and a second side comprising a side recessed channel, wherein the top protruding ridge of a first interlocking block is formed to fit within a bottom recessed channel of a second interlocking block, and wherein a side protruding ridge of the second interlocking block is formed to fit within a side recessed channel of a third interlocking block, wherein a plurality of interlocking blocks connected together form a wall;

a mounting base comprising a base strip sized to fit within at least one of the bottom recessed channel and the side recessed channel; and at least one corner male-female pillar comprising:

a top portion;

a bottom portion comprising a first bottom recessed channel and a second bottom recessed channel substantially perpendicular to the first bottom recessed channel;

a first side comprising a side recessed channel;

a second side;

a front portion comprising a front portion protruding ridge; and a rear portion, wherein at least one of the top protruding ridge and the side protruding ridge of the plurality of interlocking blocks is formed to fit within the side recessed channel of the corner male-female pillar, wherein the front portion protruding ridge of the corner male-female pillar is formed to fit within at least one of the bottom recessed channel and the side recessed channel of the plurality of blocks, the base strip is formed to fit within the first bottom recessed channel and the second bottom recessed channel of the corner male-female pillar, wherein the corner male-female pillar further comprises a center channel, wherein one of the plurality of posts is formed to fit within the center channel.

* * * * *